US005208864A

United States Patent [19]

Kaneda

[11] Patent Number: 5,208,864

[45] Date of Patent: May 4, 1993

[54] METHOD OF DETECTING ACOUSTIC SIGNAL

[75] Inventor: Yutaka Kaneda, Tokyo, Japan

[73] Assignee: Nippon Telegraph & Telephone Corporation, Japan

[21] Appl. No.: 490,773

[22] Filed: Mar. 8, 1990

[30] Foreign Application Priority Data

Mar. 10, 1989 [JP] Japan ..... 1-58953

[51] Int. Cl.[5] ..... G10L 3/00; H04R 3/00; H04R 75/00

[52] U.S. Cl. ..... 381/46; 381/47; 381/41; 381/92; 381/155

[58] Field of Search ..... 381/46, 47, 40, 41, 381/92, 155

[56] References Cited

U.S. PATENT DOCUMENTS

| | | | |
|---|---|---|---|
| 4,195,360 | 3/1980 | Fothergill | 367/136 |
| 4,215,241 | 7/1980 | Pinkney | 367/197 |
| 4,412,097 | 10/1983 | Ishigaki et al. | 381/92 |
| 4,536,887 | 8/1985 | Kaneda et al. | 381/92 |
| 4,559,642 | 12/1985 | Miyaji et al. | 381/92 |
| 4,589,137 | 5/1986 | Miller | 381/92 |
| 4,653,102 | 3/1987 | Hansen | 381/47 |
| 4,696,043 | 9/1987 | Iwahara et al. | 381/92 |
| 4,888,807 | 12/1989 | Reichel | 381/92 |

FOREIGN PATENT DOCUMENTS 2128054 4/1984 United Kingdom .

OTHER PUBLICATIONS

IEEE 1966 International Convention Record Part 2 "Radio Communication; Broadcasting"; Audio Mar. 21-25, 1966 pp. 148-156 Torick et al.

IEEE Transactions on Acoustics Speech and Signal Processing vol. 34, No. 6 Dec. 1986 pp. 1391-1400 Kaneda et al. "Adaphve Microphone Array System for Noise Reduction".

"Computer-Steered Microphone Arrays for Sound Transduction in Large Rooms" by Flanagan et al. Acoustical Society of American, Nov. 1985.

*Primary Examiner*—Dale M. Shaw
*Assistant Examiner*—Kee M. Tung
*Attorney, Agent, or Firm*—Blakely, Sokoloff, Taylor & Zafman

[57] ABSTRACT

According to a method of detecting an acoustic signal, first and second sound receiving units are located at substantially the same position and are used to output signals having different target signal power to noise power ratios (S/N ratios). When a difference between the powers of the signals output from the first and second sound receiving units or a ratio of the power of the signal from the first sound receiving unit to that from the second sound receiving unit in a given period falls within a predetermined range, reception of the target signal within the given period is discriminated. The first sound receiving unit is an adaptive microphone array capable of controlling directivity characteristics in correspondence with a noise position.

5 Claims, 12 Drawing Sheets

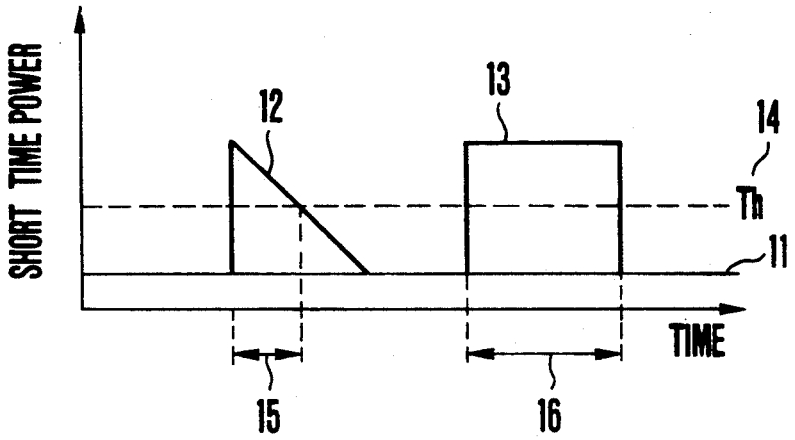
FIG.1
FIG.2(a)
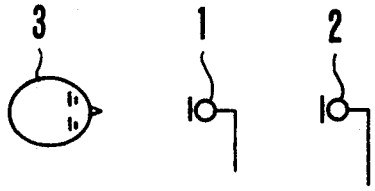
FIG.2(b)
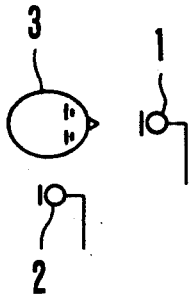

FIG.3(a)
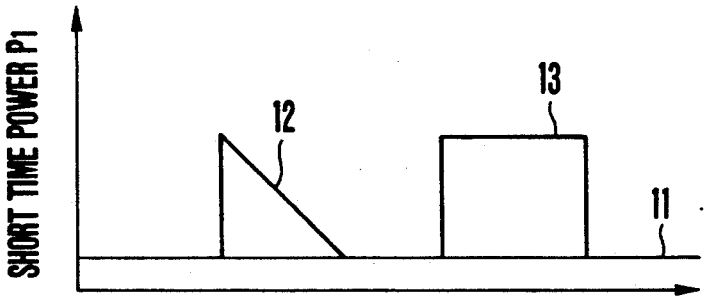
FIG.3(b)
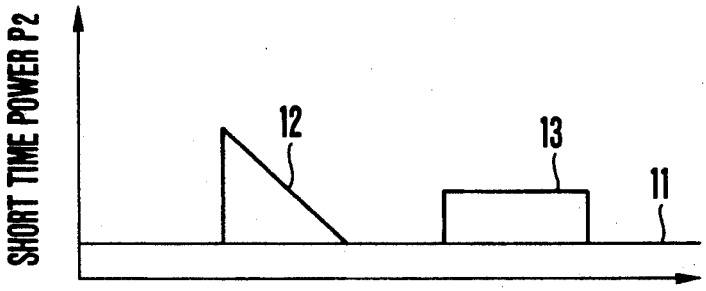
FIG.3(c)
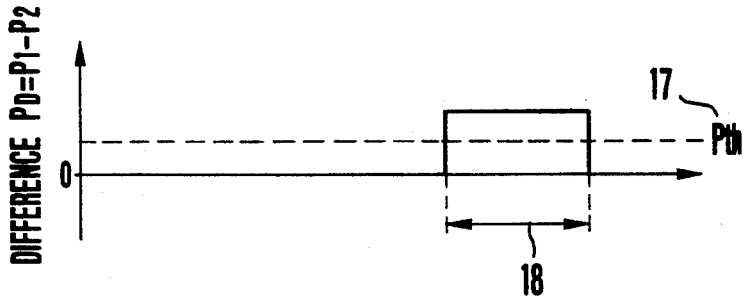
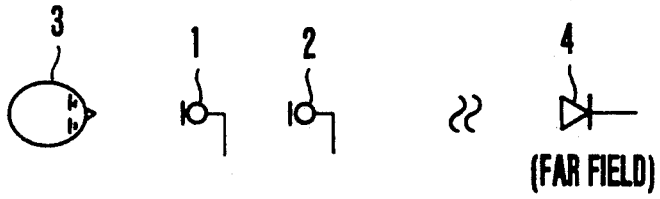
FIG.4

METHOD OF DETECTING ACOUSTIC SIGNAL

BACKGROUND OF THE INVENTION

The present invention relates to a method of detecting an acoustic signal, and a method of detecting a period of a desired acoustic signal in a signal including noise and the desired acoustic signal.

In recent years, although speech recognition apparatuses have been remarkably developed, the development of a speech recognition apparatus for recognizing speech in a noisy environment has been retarded because it is difficult to correctly detect a speech period (i.e., to detect a period during which speech is present on the time axis) in a signal contaminated by noise. When a noise period is recognized as a speech period, noise is forcibly caused to correspond to any phoneme, and it is impossible to obtain a correct speech recognition result. Therefore, it is very important to develop a speech period detection technique which can be used in a noisy environment.

FIG. 1 is a timing chart for explaining the first conventional speech period detection method. This chart shows changes in short time power as a function of time. The short time power of a signal output from a microphone is plotted along the ordinate, and the time is plotted along the abscissa. In the following description, the short time power will be referred to as a "power". A signal generally contains stationary noise 11 (noise having almost a constant power, such as air-conditioning noise or fan noise of equipment), unstationary noise 12 (noise whose power is greatly changed, such as a door closing sound and undesired speech), and desired speech 13. Although the power of the stationary noise can be known in advance, the unstationary noise power is unpredictable.

According to the first conventional method, a power of a signal is kept monitored. When this power exceeds a threshold value Th14 determined on the basis of the stationary noise power, the corresponding period is recognized as a speech period. Most of the existing speech recognition apparatuses perform speech period detection by using this method. According to this method, although a correct speech period 16 shown in FIG. 1 can be detected, an unstationary noise period 15 having a high power is also erroneously detected as a speech period, resulting in inconvenience.

The second conventional method will be described below.

According to the second conventional method, two microphones are located to cause an S/N ratio difference between outputs from the two microphones. The examples of microphone arrangement for the method are shown in FIGS. 2(*a*) and 2(*b*). That is, as shown in FIG. 2(*a*), a first microphone 1 is located near a speaker 3, and a second microphone 2 is located away from the speaker 3. Alternatively, as shown in FIG. 2(*b*), the first microphone 1 is located in front of the speaker 3, and the second microphone 2 is located near the side of the speaker 3. In these arrangement, the speech power level of the output from the first microphone is higher than that from the second microphone. On the other hand, assuming that noise is generated in a remote location, the noise power levels of the outputs from these microphones are almost equal to each other. As a result, an S/N ratio difference in outputs of the two microphones occurs.

FIGS. 3(*a*), 3(*b*), and 3(*c*) are charts for explaining an ideal operation of the second conventional method. More specifically, FIG. 3(*a*) shows a time change in power P1 of the output from the first microphone, and FIG. 3(*b*) shows a time change in power P2 of the output from the second microphone. Reference numerals 11 in FIGS. 3(*a*) and 3(*b*) as in FIG. 1 denote stationary noise; 12, unstationary noise, and 13, speech. Since the two microphones are arranged as shown in FIG. 2(*a*) or FIG. 2(*b*), the power of the speech in FIG. 3(*b*) is lower than that in FIG. 3(*a*), while the noise power levels of these outputs are equal to each other. As shown in FIG. 3(*c*), according to the second conventional method, a difference PD (=P1−P2) between the short time powers P1 and P2 of the two signals is calculated. When the power difference PD is larger than a given threshold value Pth17, a corresponding time period 18 is detected as a speech period. According to the second conventional method, as is apparent from FIG. 3(*c*), the unstationary noise period having a high power is not detected as a speech period, unlike in the first conventional method.

The second conventional method, however, is rarely operated in an ideal state because the following three conditions must be satisfied to correctly detect a speech period by utilizing a power difference in the two signals:

Condition 1: An S/N ratio difference in two signals must be present.

Condition 2: Noise and speech periods of the two signals must be matched with each other as a function of time.

Condition 3: A variation in S/N ratio difference caused by various factors is small (stability of the S/N ratio difference).

According to the second conventional method, the first condition is satisfied, while the second and third conditions are not satisfied. Therefore, the following problems are posed.

The first problem will be described below. FIG. 4 shows an arrangement obtained by adding a noise source 4 to the arrangement of FIG. 2(*a*). At this time, speech is input to the first microphone 1 and then the second microphone 2. However, noise is input to the second microphone 2 and then the first microphone 1. Therefore, the speech and noise periods of the two microphone output signals are not matched as a function of time.

The above situation is shown in FIGS. 5(*a*), 5(*b*), and 5(*c*). FIG. 5(*a*) shows the power P1 of the output from the first microphone 1, FIG. 5(*b*) shows the power P2 of the output from the second microphone 2, and FIG. 5(*c*) shows the power difference PD. Reference numeral 11 denotes stationary noise; 12, unstationary noise; and 13, speech, as in FIGS. 3(*a*) to 3(*c*).

Relationships between the speech powers and the noise powers in FIGS. 5(*a*) and 5(*b*) are the same as those in FIGS. 3(*a*) and 3(*b*). However, in the relationships shown in FIGS. 5(*a*) and 5(*b*), the speech as the output from the second microphone 2 is delayed from that as the output from the first microphone 1 by a period $\tau$S31, whereas the noise as the output from the second microphone 2 advances from that from the output from the first microphone by a period $\tau$N32. The speech and noise periods are not matched with each other as a function of time. As a result, the difference PD between the two signal powers is different from that of FIG. 3(*c*), as shown in FIG. 5(*c*). When a period during which the difference exceeds the threshold value Pth17 is detected as a speech period, a period 33 in FIG. 5(c) is erroneously detected as a speech period, thus posing the first problem. Because the time difference τN32 in this noise period is greatly changed depending on the position of the noise source, it is impossible to establish matching by using a delay element.

As the second problem, there are various factors for changing an S/N ratio difference between the two microphone outputs in a practical situation, therefore, it is difficult to assure stability of the S/N ratio difference between the two signals as follows.

The first variation factor is the position of the noise source. As described above, the noise source is assumed to be located in a remote location. When, however, the noise source is located at a relatively close location, the position of the noise source becomes a large variation factor for the S/N ratio difference. FIGS. 6(a) and 6(b) explain this situation. Reference numerals 1 and 2 in FIGS. 6(a) and 6(b) denote first and second microphones, respectively; 3, speakers; and 4, noise sources, as in FIG. 4. When the noise source 4 is located at positions indicated in FIGS. 6(a) or 6(b), the noise power of the output from the first microphone 1 is higher than that from the second microphone 2, as in the speech powers. As a result, an S/N ratio difference between the two microphone outputs becomes fairly small.

The second variation factor is movement of the speaker. For example, when the speaker 3 turns his head in a right 45° direction in FIG. 6(b), the speech signal is received by each microphone at almost the same level. As a result, a speech power difference does not occur in the outputs of the two microphones, thus an S/N ratio difference varies.

The third variation factor is an influence of room echoes. When two microphones are located so as to cause the S/N ratio difference in their outputs, room echoes having different time structures and magnitudes are added to the noise and speech components of the each microphone output. As a result, an S/N ratio is difference greatly changed as a function of time.

In addition to the above mentioned major variation factors, there are other factors such as electrical noise and vibration noise. Therefore, it is very difficult to find a microphone arrangement which assure a stable S/N ratio difference in an atmosphere where these various factors for changing the S/N ratios are present.

As described above, the second conventional method has the above decisive drawback and cannot be effectively utilized in practical applications.

The third conventional method for overcoming this drawback of the second conventional method will be described with reference to FIG. 7. Referring to FIG. 7, reference numeral 1 denotes a first microphone; 2, a second microphone; 21, a short time power calculation unit; 22, a speech period candidate detection unit; 23 and 24, average power calculation units for speech period candidates; 25, a power difference detection unit; and 26, a speech period candidate testing unit.

According to this method, as in the second conventional method, the first microphone is located such that a ratio of speech to ambient noise is large, whereas the second microphone is located such that an S/N ratio is smaller than that of the first microphone. According to this method, a short time power of an output signal from the first microphone 1 is calculated by the short time power calculation unit 21. The short time power of the signal is kept monitored by the speech period candidate detection unit 22. The speech period candidate detection unit 22 detects a speech period candidate as a period when its power exceeds a threshold value Th. The above operations are the same as those in the first conventional method shown in FIG. 1. The noise period 15 shown in FIG. 1 is detected as a speech period candidate. Then, average powers of the outputs from the first and second microphones during this candidate period are calculated by the average power calculation units 23 and 24. Next, the difference PDL between two average powers is obtained by the power difference detection unit 25. Finally, when the power difference PDL exceeds a predetermined threshold value PDLt, this candidate period is recognized as a correct speech period by the speech period candidate testing unit 26. Otherwise, this candidate period is discarded.

According to the characteristic feature of the third conventional method, a difference between the average powers obtained within a relatively long time candidate period, is calculated in place of the short time power difference. Even if the speech and noise periods of one microphone output are not matched with those of the other microphone output, as shown in FIGS. 5(a) and 5(b), or even time variations in S/N ratio caused by room echoes occur, its influence on the average power difference is reratively small. Therefore, the third conventional method seems to solve the problems of the second conventional problem.

In the third conventional method, however, since the speech period is determined based on the average power within the candidate period, an incorrect discrimination result occurs when the noise and speech periods appear continuously, as shown in FIG. 8. FIG. 8 shows an output from the first microphone. A correct speech period is a period 34 in FIG. 8. As shown in FIG. 8, since unstationary noise 12 is close to speech 13 along the time axis, a period 35 which contains both the noise and speech periods and the short time power of which exceeds a threshold value Th14 is detected as a speech period candidate. When this candidate period 35 is discriminated as a correct speech period upon calculation of an average power difference, a period 36 shown in FIG. 8 becomes an erroneously detected period. When the above speech period is discarded, the correct speech period is recognized as a non-speech period. In either case, an erroneous discrimination result is obtained.

The third conventional method, therefore, cannot serve as a means for solving the drawback of the second conventional method.

Various problems are present in the conventional speech period detection methods. It is therefore difficult to correctly detect a speech period when unstationary noise is present in an input signal.

SUMMARY OF THE INVENTION

It is therefore a principal object of the present invention to provide a method of detecting an acoustic signal, capable of detecting an speech period in an atmosphere of unstationary noise with higher precision than a conventional technique.

It is another object of the present invention to provide a method of detecting an acoustic signal, capable of detecting a speech period with high precision even if a noise source is present at an arbitrary position except for a position near a speaker (+30° range when the speaker is viewed from the microphone), and even if the speaker moves within an expected range.

In order to achieve the above objects of the present invention, the following requirements are indispensable. That is, in order to correctly detect a speech period by using a power difference between two signals, the following three conditions must be satisfied:

Condition 1: An S/N ratio difference in two signals must be present.

Condition 2: Noise and speech periods of the two signals must be matched with each other as a function of time.

Condition 3: A variation in S/N ratio difference caused by various factors is small (stability of the S/N ratio difference).

According to the first feature of the present invention, in order to satisfy both the first and second conditions, two sound receiving units for generating signals having different S/N ratios are located at a single position (strictly speaking, this single position can be positions which can be deemed to be a single position to effectively operate the present invention), and a speech period is detected by using a power difference between the two output signals. According to the second feature of the present invention, one of the two sound receiving units comprises a microphone array system having a directivity control function to satisfy the third condition.

According to the first feature of the present invention, since noise and speech reach both the sound receiving units at the identical time, the noise and speech periods of an output from one sound receiving unit are matched with those from the other sound receiving unit as a function of time, thus satisfying the second condition and solving the first problem of the second conventional method.

When the two sound receiving units are located at the single position, the time structures of the echoes added to the signals are equal to each other. Therefore, the influence of the echoes which causes variations in S/N ratio difference between the two sound receiving unit outputs, as pointed as the second problem of the second conventional method, can be greatly reduced by the first feature of the present invention.

According to the second feature of the present invention, variations in S/N ratio difference between the two sound receiving unit outputs caused by the position of the noise source and movement of the speaker, as pointed out as the second problem of the second conventional problem, can be decreased. This will be described in detail later.

The present invention will be described in detail with reference to preferred embodiments in conjunction with the accompanying drawings.

BRIEF DESCRIPTION OF THE DRAWINGS

FIG. 1 is a chart showing the first conventional speech period detecting method;

FIGS. 2(*a*) and 2(*b*) are views showing microphone arrangements for explaining the second conventional speech period detecting method;

FIGS. 3(*a*), 3(*b*), and 3(*c*) are charts for explaining an ideal operation of the second conventional method;

FIG. 4 is a view showing a positional relationship between microphones and a noise source;

DETAILED DESCRIPTION OF THE PREFERRED EMBODIMENTS

Figure 5A:
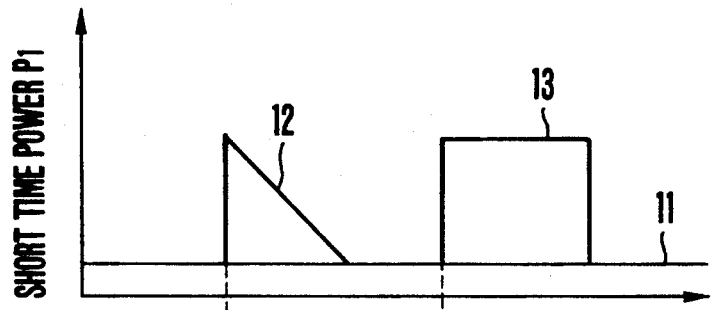
FIGS. 5(*a*), 5(*b*), and 5(*c*) are charts for explaining problems of the second conventional method.
Figure 5B:
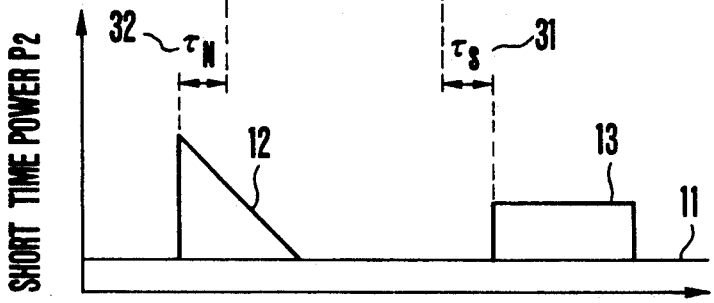
Figure 5C:
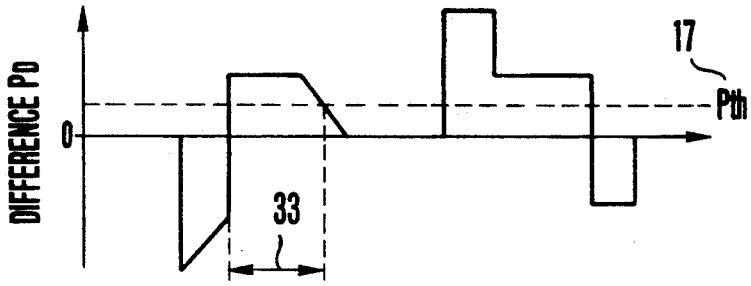
Figure 6A:
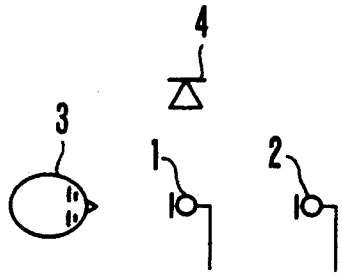
FIGS. 6(*a*) and 6(*b*) are views each showing a relationship between microphones and a noise source.
Figure 6B:
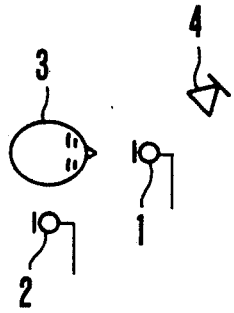
Figure 7:
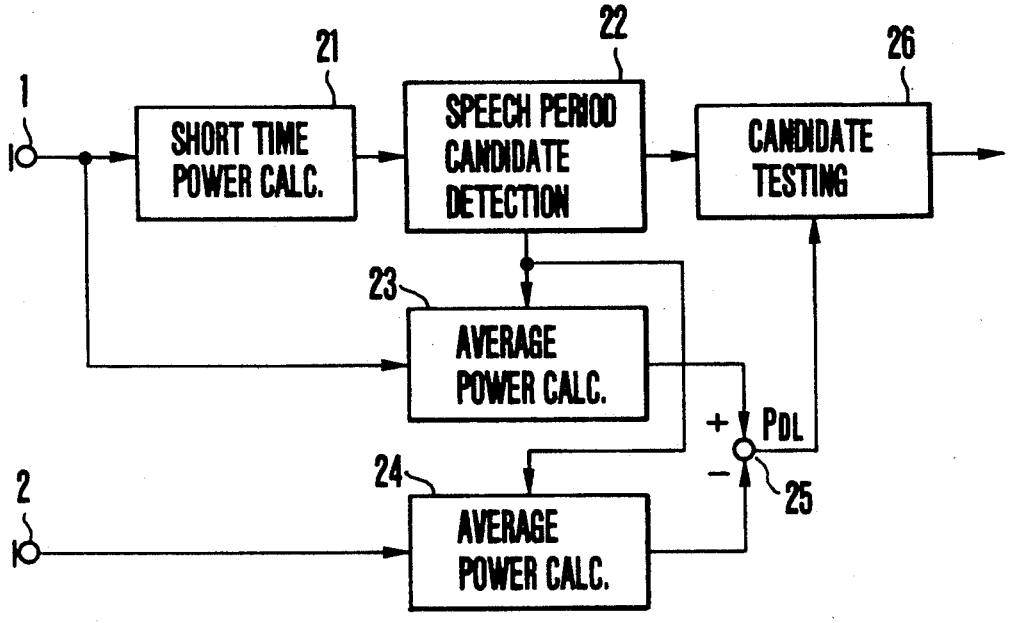
FIG.7 PRIOR ART
FIG. 7 is a block diagram showing a third conventional speech period detecting method.
Figure 8:
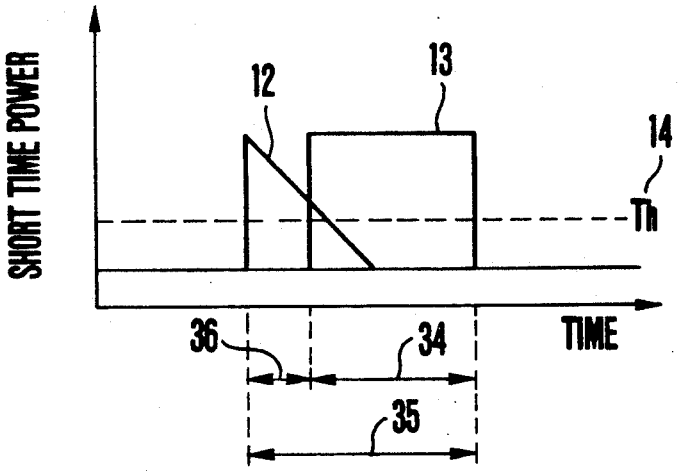
FIG. 8 is a chart for explaining a problem of the third conventional method described in FIG. 7.
Figure 9:
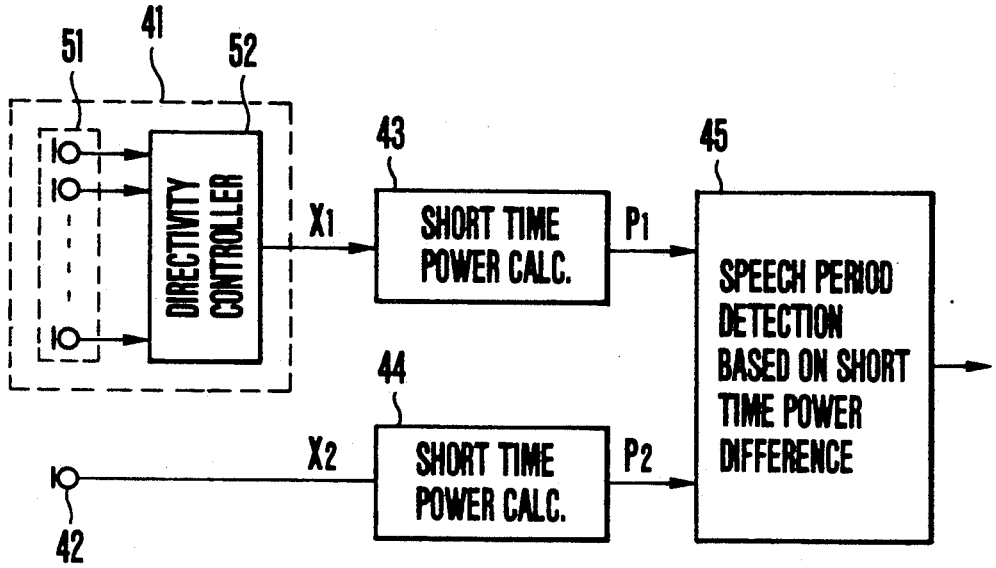
FIG. 9 is a block diagram for explaining an embodiment of a method of detecting an acoustic signal according to the present invention.

An arrangement of the present invention is shown in FIG. 9. Referring to FIG. 9, reference numeral 41 denotes a first sound receiving unit (i.e., a microphone array system) for outputting a signal having a high S/N ratio. The first sound receiving unit 41 comprises a microphone array 51 consisting of a plurality of microphone elements and a directivity controller 52. Reference numeral 42 denotes a second sound receiving unit for outputting a signal having an S/N ratio lower than that of the output from the first sound receiving unit 41. These two sound receiving units 41 and 42 are located at the same position. Reference numerals 43 and 44 denote short time power calculation units; and 45, a speech period detection unit based on a short time power difference.

In order to describe the effectiveness of the microphone array system in the present invention, assume that a unidirectional microphone is used as the first sound receiving unit 41 in place of the microphone array system, and that an omnidirectional microphone is used as the second sound receiving unit 42. With this arrangement, an S/N ratio of an output from the first sound receiving unit directed toward the speaker is larger than that of the output from the omnidirectional second sound receiving unit.

Figure 10A:
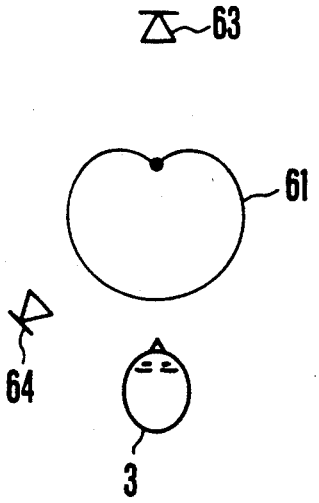
FIGS. 10(*a*) and 10(*b*) are views for explaining problems posed when unidirectional and omnidirectional microphones are used.
Figure 10B:
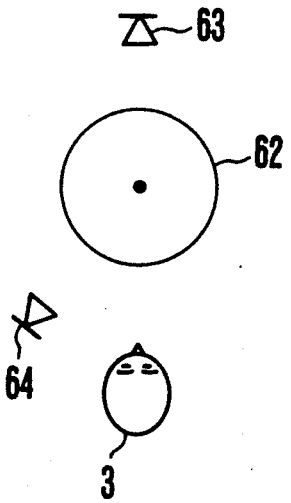

The above method is not always operated well, as will be described with reference to FIGS. 10(*a*) and 10(*b*). Referring to FIGS. 10(*a*) and 10(*b*), reference numeral 61 denotes a directivity pattern of a unidirectional microphone; and 62, a directivity pattern of an omnidirectional microphone. Reference numerals 3 denote speakers; and 63 and 64, positions of the noise sources. As shown in FIG. 10(*a*), the unidirectional microphone has a high sensitivity in the speaker side and a low sensitivity in the opposite side. FIG. 10(*b*) shows the omnidirectional microphone has equal sensitivity levels in all directions. When the noise source is located at the position 63 in each of FIGS. 10(*a*) and 10(*b*), an S/N ratio of an output from the unidirectional microphone is larger than that of an output from the omnidirectional microphone. However, when the noise source is located at the position 64 (or moved to the position 64) in FIGS. 10(*a*) and 10(*b*), the sensitivity of the unidirectional microphone for noise is much increased, and a difference between the S/N ratios of the outputs from the unidirectional and omnidirectional microphones becomes fairly small. In this manner, by the method using the unidirectional microphone as the first sound receiving unit, the S/N ratios are greatly changed depending on the position of the noise source.

Figure 11:
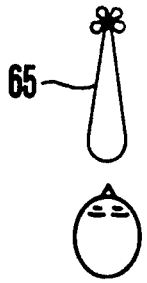
FIG. 11 is a view for explaining a problem posed when a superdirectional sound receiving unit is used.

The problem posed by use of the unidirectional microphone may be solved by using a so-called "superdirectional sound receiving unit" as the first sound receiving unit 41 of FIG. 9. However the directivity characteristics of the "superdirectional sound receiving unit" generally vary depending on frequencies. The directivity characteristics have almost omnidirectivity in a low-frequency range and very sharp directivity as shown in FIG. 11 in a high-frequency range. As a result, the S/N ratios are changed depending on the position of the noise source in the low-frequency range, and the S/N ratios are changed depending on slight movement of the speaker in the high-frequency range.

As described above, in order to obtain good speech period detection results, it is difficult to use a general-purpose directional sound receiving unit as the first sound receiving unit 41 in the arrangement of the present invention shown in FIG. 9.

In the present invention using the microphone array system having a directivity control function, the variations in S/N ratio can be kept small for changes in noise source position and movement of the speaker. This will be described in detail below.

Figure 12:
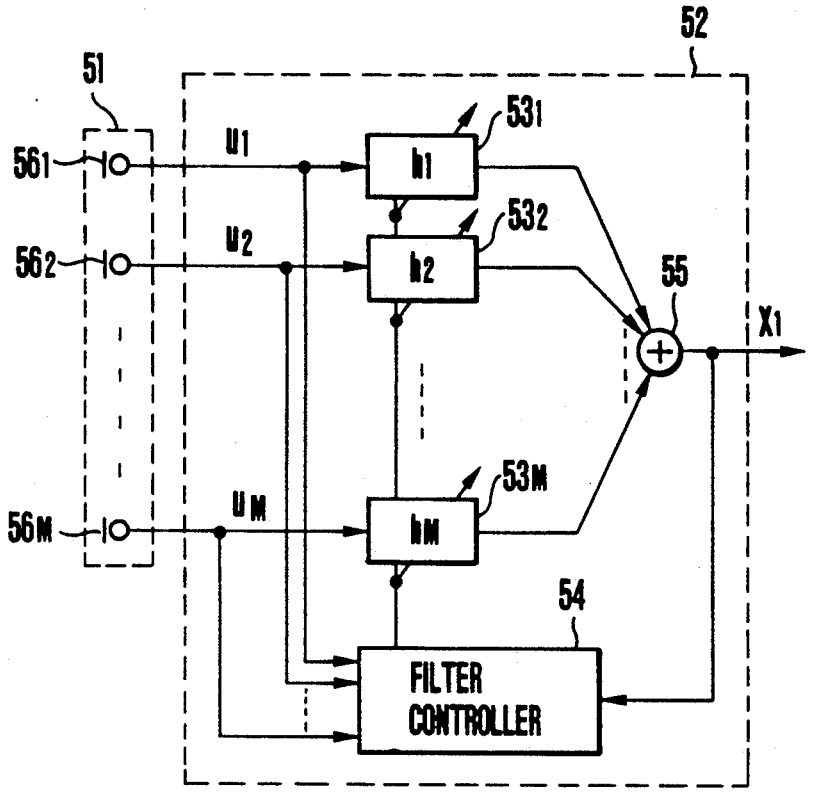
FIG. 12 is a block diagram of a detailed arrangement of a first sound receiving unit shown in FIG. 9.

A typical example of a microphone array system having a directivity control function is a sound receiving unit called an adaptive microphone array. An arrangement of the adaptive microphone array is shown in FIG. 12. Referring to FIG. 12, reference numeral 51 denotes a microphone array consisting of M microphone elements $\mathbf{56}_1$ to $\mathbf{56}_M$; and 52, a directivity controller. The directivity controller 52 comprises filters $\mathbf{53}_1$ to $\mathbf{53}_M$ respectively connected to microphone outputs, an adder 55 for adding filter outputs, and a filter controller 54.

The filter controller 54 receives each microphone output signal and an output $x_1$ from the adder 55 and controls the characteristics of the filters $\mathbf{53}_1$ to $\mathbf{53}_M$ to reduce a noise component contained in the output $x_1$.

The principle of operation of the filter controller 54 will be described below. The output signal $x_1$ from the adder 55 can be expressed as a sum of a speech component s and a noise component n as follows:

$$x_1 = s + n \tag{1}$$

When filter characteristics for minimizing a power $n^2$ of the noise component are unconditionally obtained, all the filters $\mathbf{53}_1$ to $\mathbf{53}_M$ become filters having zero gain. As a result, although the noise component n becomes minimized to zero, the speech component s is not output either. Therefore, a constraint is imposed on the speech component s contained in the signal $x_1$ obtained as a result of a filtering operation. Then, filter characteristics for minimizing the noise component n contained in the output signal $x_1$ under this constraint are obtained. The constraint may be $s = s_0$ where $S_0$ is a speech component contained in a microphone output signal (i.e., a filter input signal) or a condition in which a mean value of $|s - s_0|^2$ is kept to be a threshold value or less.

When outputs from the M microphone elements are denoted as $U_1$ to $U_M$, and characteristics of the filters $\mathbf{53}_1$ to $\mathbf{53}_M$ are given as $h_1$ to $h_M$, a power $x_1^2$ of the signal $x_1$ is represented as follows:

$$x_1^2 = \left( \sum_{k=1}^{M} k_k U_k \right)^2 \tag{2}$$

Assuming that the speech and the noise are mutually uncorrelated, the following equation is derived from equation (1):

$$x_1^2 = s^2 + n^2 \tag{3}$$

Judging from equations (2) and (3), the power $n^2$ of the noise component contained in the output signal $x_1$ is a second order function of the filter characteristics $h_1$ to $h_M$. Therefore, filter control for minimizing the power $n^2$ of the noise component under the constraint results in well-known minimization problem of the second order function with a constraint.

Various solutions for various constraints, and practical algorithms are described in detail in "Introduction to Adaptive Arrays", R. A. Monzingo et al., John Wiley & Sons, New York, 1980 and U.S. Pat. No. 4,536,887.

Figure 21:
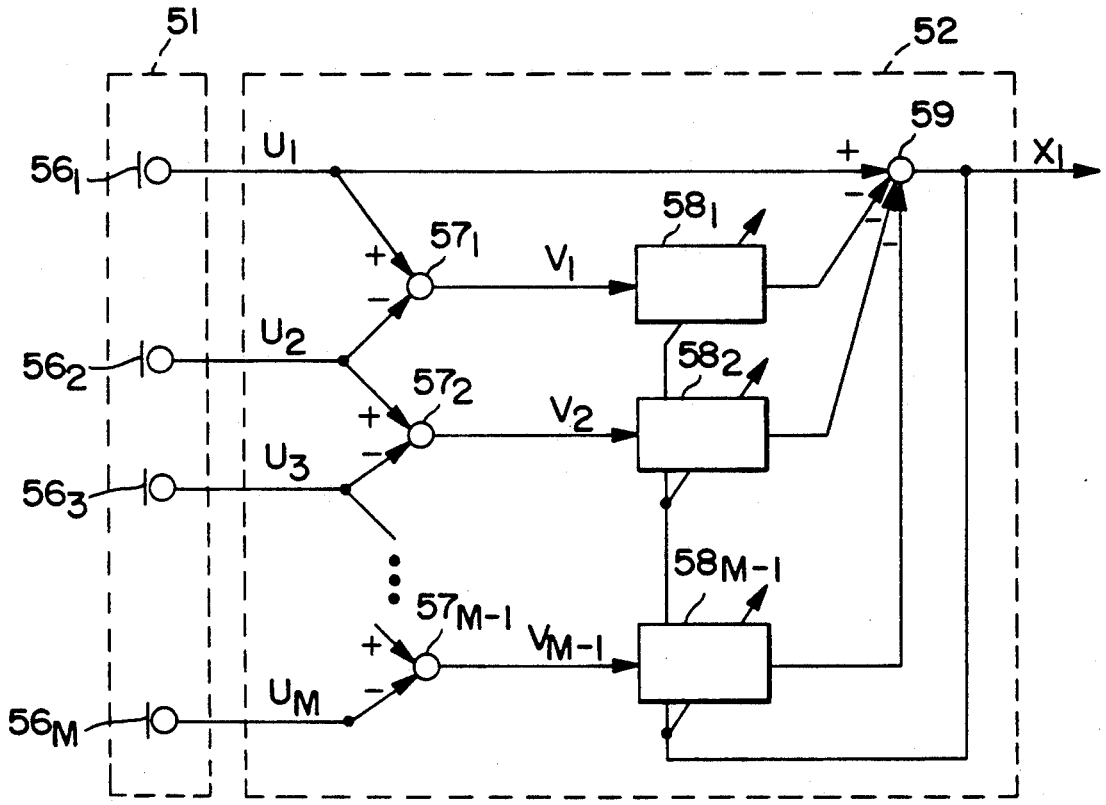
FIG. 21 is an alternative, yet equivalent, illustration of the diagram of FIG. 12.

A specific example of the method of realizing an adaptive microphone array will be described. FIG. 21 shows a method proposed by Griffiths and Jim. In FIG. 21, parts corresponding to those in FIG. 12 are denoted by like refernce numerals, and corresponding signals are shown as like signals. Reference numeral 51 denotes a microphone array consisting of M microphone elements $\mathbf{56}_1$ to $\mathbf{56}_M$ and a directivity controller 52. The directivity controller 52 comprises subtracting units $\mathbf{57}_1$ to $\mathbf{57}_{M-1}$, adaptive filters $\mathbf{58}_1$ to $\mathbf{58}_{M-1}$, and a subtracting unit 59. The subtracting units $\mathbf{57}_i$ (i being 1, 2, . . . , M − 1) receive microphone output signals $u_i$ and $u_{i+1}$ and output subtraction results $v_i$. The adaptive filters $\mathbf{58}_1$ to $\mathbf{58}_{M-1}$ receive the subtraction results $v_1$ to $v_{M-1}$, and their outputs are subtracted in the subtracting unit 59 from the first microphone element output $u_1$ to produce an output signal $x_1$. The output signal $x_1$ is fed back to each adaptive filter.

The operation of this method is as follows. It is now assumed that the microphone elements $\mathbf{56}_1$ to $\mathbf{56}_M$ are arranged on a line, and a voice arrives as a plane wave in a direction perpendicular to the line. At this time, all the voice components contained in the microphone outputs $u_1$ to $u_M$ are in phase. Thus, by operations of taking the difference between two microphone outputs in the subtracting units $\mathbf{57}_1$ to $\mathbf{57}_{M-1}$, the voice components are cancelled, that is, the subtracting unit outputs $v_1$ to $v_{M-1}$ do not contain voice components. If noise arrives in a direction different from the direction of arrival of the noise, the noise components contained in signals $u_1$ to $u_M$ are not in phase and thus are not cancelled throughthe subtracting operation. Thus, the signals $v_1$ to $v_{M-1}$ contain the sole noise components.

The adaptive filters correct the filter characteristics as a result of subtraction of each filter output from the first microphone element output $u_1$ so as to minimize the power of the signal $x_1$. These adaptive filters are usually realized as digital filters, and the well-known LMS algorithm or the like is used for the correction of the coefficients of the digital filters. Details of the algorithm of the adaptive filters are described in, for instance, B. Widrow and S. Samuel, "Adaptive Signal Processing", Prentice-Hall, 1985. Also, various commercially available LSI chips for realizing the function of the adaptive filter may be utilized.

Since the signal $v_1$ to $v_{M-1}$ contains the sole noise components, the noise component contained in signal $u_1$ is not affected by the subtracting operation in the subtracting unit 59. This means that the operation of the adaptive filters for minimizing the power of the output $x_1$ minimizes the power of the noise component contained in the output $x_1$. Thus, it is to be understood that the adaptive microphone array structure shown in FIG. 21 is a method for minimizing the noise component under a condition of $x_1=s$.

The structure shown in FIG. 21 may seem to be different from that shown in FIG. 12. However, FIG. 21 is produced from FIG. 12 for facilitating the understanding of the description, and these two Figures are equivalent. Actually, the function of the filter controller 54 shown in FIG. 12 is provided by the adaptive filters $58_1$ to $58_{M-1}$ shown in FIG. 21. Further, considering characteristics between the input and output sides of the directivity controller 52, there are correspondence relations $h_1=1-g_1$, $h_i=g_{i-1}-g_i$ (for $i=2, 3, \ldots, M$), $g_i$ being the filter characteristic of the i-th adaptive filter $58_i$.

To reduce the noise component contained in the output signal $x_1$ is to reduce the sensitivity of the array system in noise arrival directions. As a result, this array system has a high sensitivity for a target direction and a low sensitivity in unknown noise arrival directions.

Figure 13:
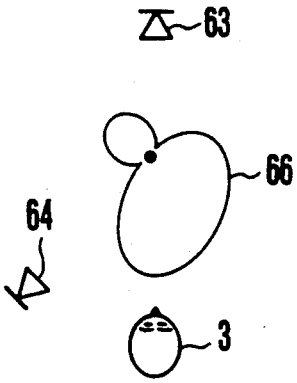
FIG. 13 is a view showing directivity characteristics of an adaptive microphone array.

FIG. 13 shows typical directivity characteristics 66 formed by the adaptive array. Reference numeral 3 in FIG. 13 denotes a speaker as in the previous embodiments; and 63 and 64, noise sources. As can be apparent from FIG. 13, although the adaptive array does not have sharp directivity, but has directivity having a low sensitivity in the noise source directions. A portion having this low sensitivity in the directivity is called a "dead angle". When the microphone array consists of M elements, (M−1) dead angles can be formed by the array system.

When noise reflected indoors reaches the adaptive array having such directivity from many directions in addition to the noise source direction, the resultant S/N ratio is small as compared with that of the superdirectional sound receiving unit. However, adaptive array has a feature capable of obtaining almost a constant S/N ratio for all noise source locations except the neighborhood of a speaker (about +30° range when the speaker is viewed from the adaptive array), and it has a feature of small variations in the S/N ratio upon movement of the speaker 3 since adaptive array does not have sharp directivity in the speaker direction. According to these features, the adaptive microphone array is very suitable for assuring stability in an S/N ratio difference for detecting a speech period by using a difference between the two signal power levels.

The adaptive microphone array has an additional feature capable of reducing variations in noise power as a function of time.

Noise components reflected by walls, a floor, and a ceiling in addition to noise directly from the noise source are input to the sound receiving unit indoors. It is impossible for the adaptive microphone array to form dead angles in all direct and reflected noise directions. When the microphone array consists of M microphone elements, (M−1) dead angles are formed in the directions where the sound is directly input or an echo having a high energy is input, thereby improving the S/N ratio.

Figure 14A:
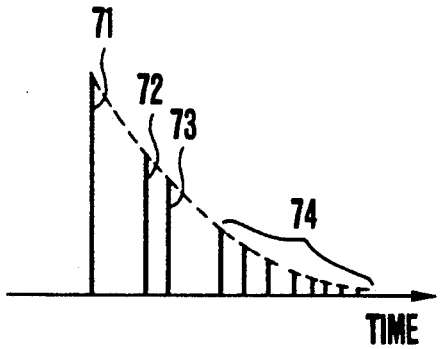
FIGS. 14(*a*) and 14(*b*) are charts showing waveforms of reception signals of impulsive noise with room echoes when an omnidirectional microphone and an adaptive microphone array are used.
Figure 14B:
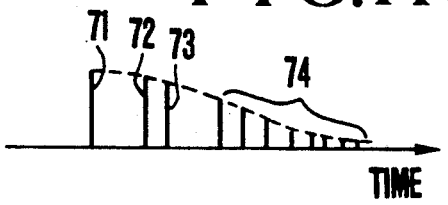

This effect will be described with reference to FIGS. 14(*a*) and 14(*b*). FIG. 14(*a*) shows impulsive noise with room echoes received by an omnidirectional microphone, and FIG. 14(*b*) shows the one received by an adaptive microphone array. Reference numeral 71 in FIG. 14(*a*) denotes noise directly input from a noise source; and 72, 73, and 74, echoes of noise reflected once or a plurality of times by the walls or floor and then received. The energy levels of the echoes 72, 73, and 74 are exponentially decreased as a function of time as compared with the energy level of the direct noise 71. If the number of microphone elements constituting the array is 4, three dead angles are formed in the noise source direction and the directions of the echoes 72 and 73. An echo power 74 of the output (FIG. 14(*b*)) from the adaptive microphone array does not have a large difference with that of the output (FIG. 14(*a*)) from the omnidirectional microphone. However, the power levels of the direct noise component and the echoes 72 and 73 are greatly decreased in FIG. 14(*b*). As a result, variations in noise power as a function of time can be apparently reduced by adaptive microphone array.

As previously described, the major factor for a detection error of a speech period is large variations in noise power as a function of time, or in other words, unstationary noise with high power causes incorrect detection. In order to cope with these noise power variations, a speech period is detected by utilizing a difference between two signal powers in the present invention. It is, however, impossible to perfectly eliminate various S/N ratio variation factors, i.e., eliminate detection errors by 100%. Therefore, the feature of the adaptive microphone array for reducing the variations in noise power, or misdetection factor, is very effective to reduce detection errors of speech periods.

There are many other choices for the second sound receiving unit 42 in FIG. 9 in addition to an omnidirectional microphone. The only requirement for the second sound receiving unit is to output a signal which satisfies the above-mentioned conditions 1 to 3 for the detection based on power difference in cooperation with the first sound receiving unit 41.

One of the microphone elements constituting the microphone array 51 may be used as the second sound receiving unit 42 in the arrangement of the present invention of FIG. 9 according to the simplest way, which will be shown in FIG. 15 (to be described later).

Figure 18:
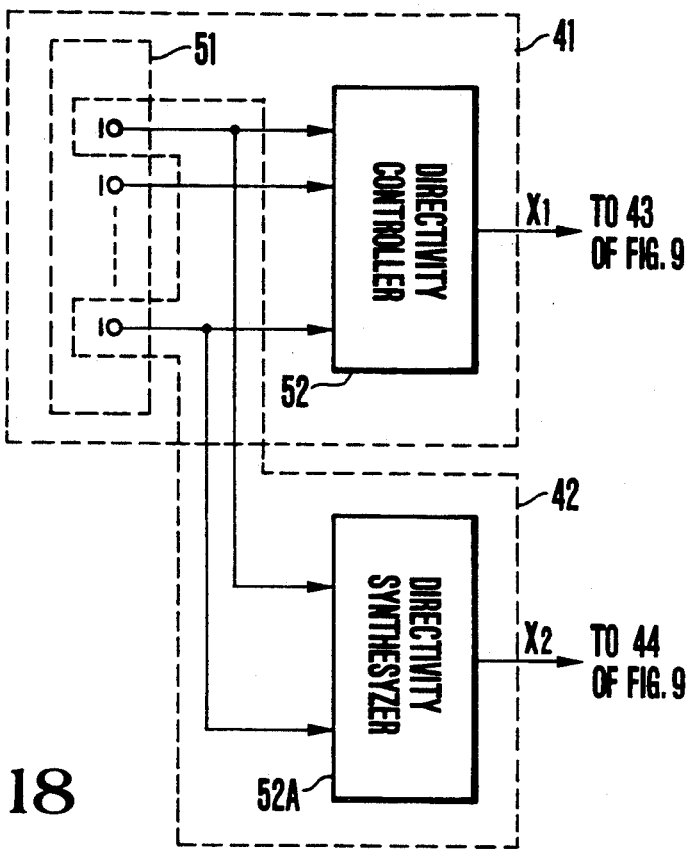
FIGS. 18, 19 and 20 are block diagrams showing other embodiments of the present invention.

The second sound receiving unit 42 may be arranged, as shown in FIG. 18. Referring to FIG. 18, the second sound receiving unit 42 comprises some of a plurality of microphones as constituent elements of the first sound receiving unit 41, i.e., a microphone array (which may sometimes be called a sub-array when compared to the overall microphone array 51 in the first sound receiving unit) and directivity synthesizer 52A. The output of the microphone array is supplied to the directivity synthesizer 52A, and a second signal $x_2$ is output from the directivity synthesizer 52A. In this specification, however, the "directivity synthesizer" is defined such that is synthesizes the directivity through the simple operations of delaying and addition on a plurality of signals. For example, in the case where the microphone array in FIG. 18 is linear and the directivity synthesizer is an adder for adding all the inputs, a high sensitivity directivity is synthesized with respect to the direction perpendicular to the line of the microphone array.

Another arrangement of a microphone array system having a directivity control function for the first sound receiving unit 41 is exemplified as a sound receiving system, as described in U.S. Pat. No. 791,418. In this system, speech signals having clear arrival directions are preserved, and signal processing is performed to suppress noise uniformly input form the ambient atmosphere. In order to properly operate this system, a condition in which a speaker position does not coincide with a noise source position must be satisfied (in this condition, the direction of the speaker position may be the same as the direction of the noise source position when viewed from the microphone). A method in this system can be deemed as a kind of directivity control in a sense that only sounds from a sound source located at a desired position are extracted.

Figure 15:
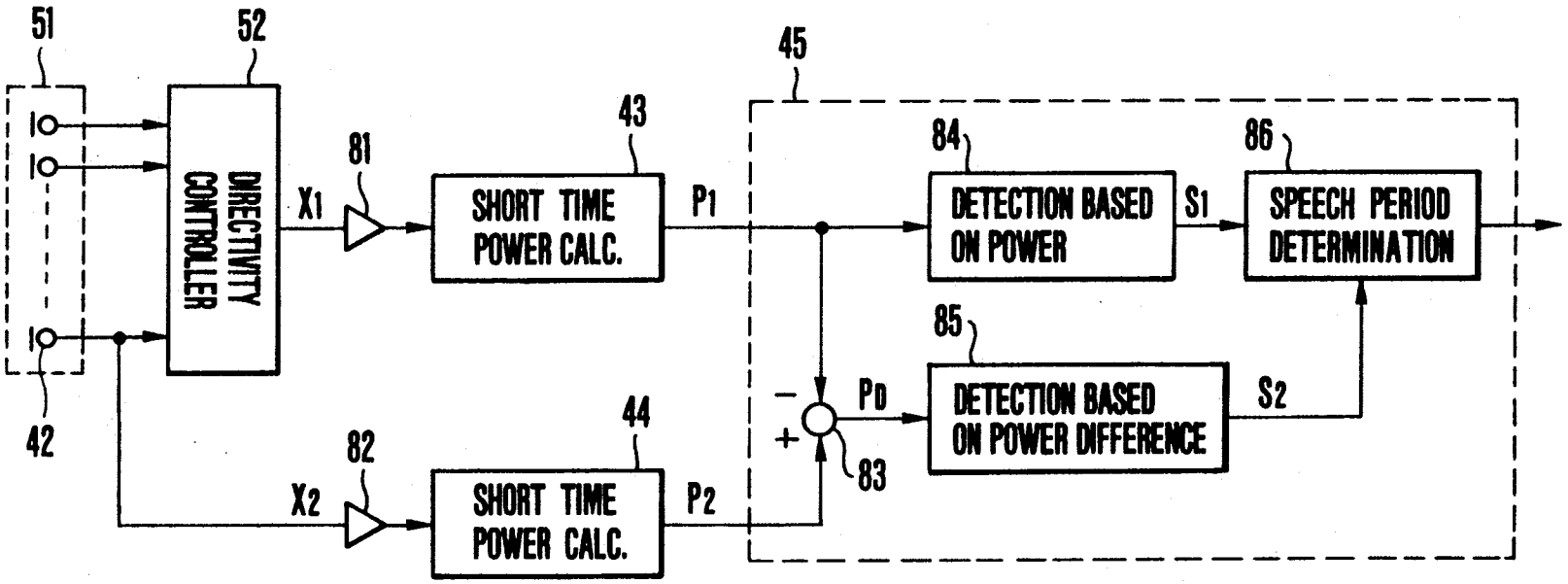
FIG. 15 is a block diagram showing a detailed arrangement of the embodiment shown in FIG. 9.

FIG. 15 is a block diagram showing a detailed arrangement of the first embodiment (FIG. 9) of the present invention. Reference numeral 51 in FIG. 15 denotes a microphone array; 52, a directivity controller; 43, a first short time power calculation unit; 44, a second short time power calculation unit; and 45, a speech period detection unit, as in the previous embodiment. Reference numeral 81 denotes a first amplifier, connected to the output of the directivity controller 52, for receiving a signal $x_1$ and sending an output to the first short time power calculation unit 43; 82, a second amplifier, connected to the second sound receiving unit 42 (one of the microphone elements of the microphone array 51 is used in this embodiment), for receiving the signal x and sending an output to the second short time power calculation unit 44; 83, a subtracter for receiving outputs pl and p2 from the first and second short time power calculation units 43 and 44; 84, a detection unit based on the power for receiving the output pl from the first short time power calculation unit 43 and detecting a short time period having a possibility for constituting part of the speech period; 85, a detection unit based on the power difference for receiving an output from the subtracter 83; and 86, a speech period determination unit for receiving an output Sl from the detection unit 84 based on the power and an output S2 from the detection unit 85 based on the power difference.

The sequence of this method will be described below.

A speech input containing noise is received by the microphone array 51. An output signal from the microphone array 51 is input to the directivity controller 52, and the directivity controller 52 generates the first signal $x_1$. An output from one of the microphone elements constituting the microphone array 51 is given as $x_2$. At this time, as a result of directivity control by the directivity controller 52, an S/N ratio of the signal $x_1$ is larger than that of the signal $x_2$.

The amplifiers 81 and 82 are used to correct signal levels such that the speech power of the signal $x_1$ is set to equal to that of the signal $x_2$. This correcting operation is not essential in the sequence. However, if this correcting operation is performed, a subsequent description can be simplified. Short time powers P1 and P2 of the signals $x_1$ and $x_2$ are calculated by the short time power calculation units 43 and 44, respectively. The short time powers P1 and P2 are represented by logarithmic values (dB) or antilogarithmic values.

The power P1 having a higher S/N ratio is input to the detection unit 84 based on the power. When the value of the power P1 is larger than a predetermined threshold value Th, the short time period detection unit 84 outputs the signal S1 of level "1" which represents a possibility that the corresponding short time period constitutes part of the speech period. Otherwise, the detection unit 84 detects a signal of level "0".

The subtracter 83 calculates the difference PD (=P2−P1) between the powers P1 and P2.

The difference PD is input to the detection unit 85 based on the power difference. When the difference PD is smaller than a predetermined threshold value Pth, the detection unit 85 based on the power difference outputs the signal S2 of level "1". Otherwise, the detection unit 85 based on the power difference outputs a signal S2 of level "0".

Finally, the output S1 from the detection unit 84 based on the power and the output S2 from the detection unit 85 based on the power difference are input to the speech period determination unit 86. When the values of the signals S1 and S2 are "1"s, respectively, the speech period determination unit 86 determines that the corresponding short time period is part of a correct speech period. Otherwise, the short time period is determined as a noise period.

Figure 16A:
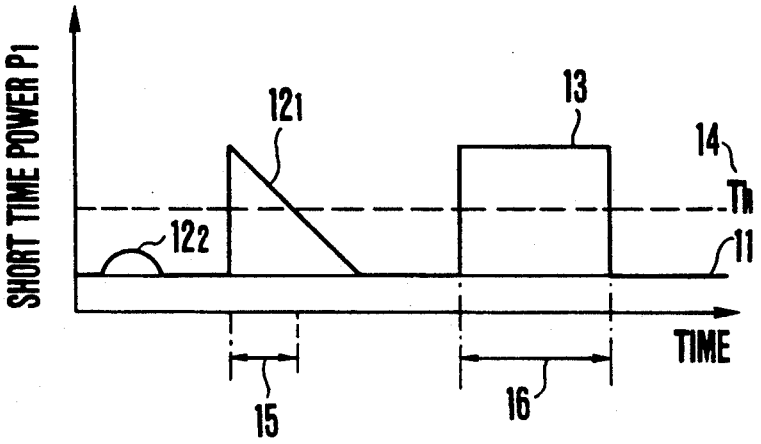
FIGS. 16(*a*), 16(*b*), and 16(*c*) are charts for explaining an operation of a speech period detection unit shown in FIG. 15.
Figure 16B:
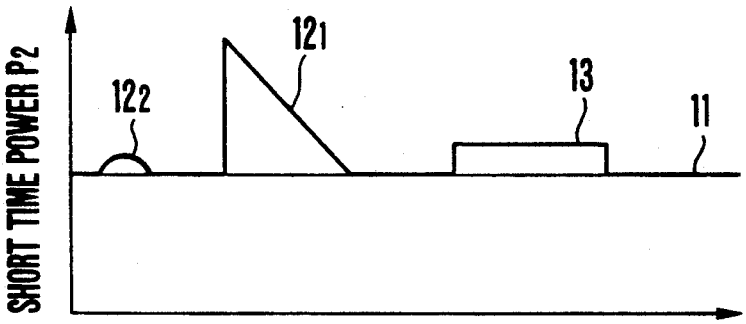
Figure 16C:
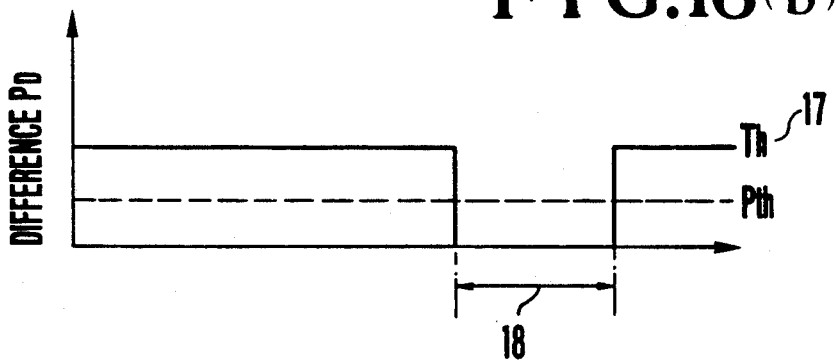

The operation of the speech period detection unit 45 based on a power difference will be described with reference to FIGS. 16(*a*), 16(*b*), and 16(*c*). FIG. 16(*a*) shows a change in power P1 of a first sound receiving unit output as a function of time, FIG. 16(*b*) shows a change in power P2 of a second sound receiving unit output as a function of time, and FIG. 16(*c*) shows the difference PD (=P2−P1) between the powers P1 and P2. The short time power of the signal is plotted along the ordinate of each of FIGS. 16(*a*) to 16(*c*), and the time is plotted along the abscissa. Reference numeral 11 denotes a stationary noise component; $12_1$ and $12_2$, unstationary noise components; and 13, speech, as in the previous embodiment.

The speech powers in the powers P1 and P2 are adjusted to be equal to each other. If the power of the stationary noise is lower than the speech power in P2, the powers of the speech periods are almost equal to each other in FIGS. 16(*a*) and 16(*b*) which represent powers by logarithmic values. On the other hand, since the output from the second sound receiving unit has a smaller S/N ratio than that from the first sound receiving unit, the noise power in FIG. 16(*b*) is higher than the noise power in FIG. 16(*a*) by an amount corresponding to a difference between the S/N ratios. As a result, the value of the difference PD between the powers P2 and P1 becomes zero during the speech period 18 and takes non-zero value during the non-speech period as shown in FIG. 16(*c*). Thus, the detection unit 85 based on the power difference outputs a signal S2 of level "1" during the correct speech period 18.

However, because various variation factors for the S/N ratio difference are present in real environments, the PD value is not always an ideal as shown in FIG. 16(*c*) value in the present invention although the variation factors are reduced by using the microphone array system having a directivity control function. For example, the PD value becomes a value larger than zero even during the speech period when the speaker moves exceeding the expected range. The PD value becomes zero even during the noise period for noise (e.g., a tongue-clicking sound of a speaker and a page turning sound) propagating from the same direction as the speech even if although the noise has a relatively low power.

Taking these points into consideration, the detection unit 84 based on the power detects as a non-speech period a short time period whose value is smaller than the threshold value Th, as shown in FIG. 16(*a*), and the detection unit 84 outputs a signal S1 of level "0". For example, even if the noise component 122 propagates from the same direction as the speech and has a small PD value during the noise period, the noise period is not erroneously detected as a speech period. Thus, effective speech period detection can be performed.

Figure 19:
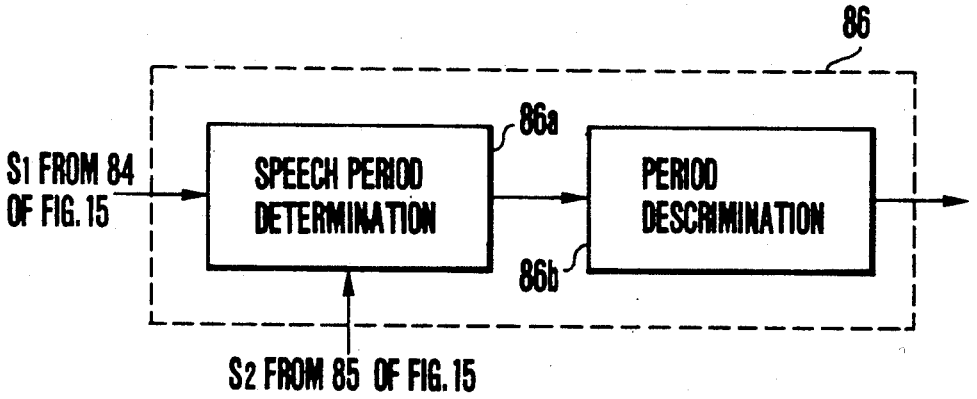

As shown in FIG. 19, in addition to a speech period determination testing means 86*a* for determining as part of a speech period a short time period when both the output S1 from the detection unit 84 based on the power and the output S2 from the detection unit 85 based on the power difference are set at "1", the speech period determination unit 86 shown in FIG. 15 may also comprise a testing means 86*b* for rediscriminating the period as part of a correct speech period only when the period determined as part of a speech period by the speech period determination means 86*a* continues exceeding a predicted value of a minimum speech duration.

The following experiment was performed to confirm effectiveness of the present invention.

Experimental Conditions

An experiment was conducted in a room having a reverberation time of 0.4 sec. Undesired speech (radio news) was produced from a loudspeaker as a noise component. Desired speech components were spoken words (names of cities) and were produced in the presence of different undesired speech components, thus receiving 100 words. The speaker and the noise source were angularly spaced apart by 45° when viewed from the sound receiving unit. An AMNOR sound receiving unit (U.S. Pat. No. 4,536,887: "Adaptive Microphone-array System for Noise Reduction", Y. Kaneda and J. Ohga, IEEE Trans. on Acoust., Speech, Signal Processing, vol. ASSP-34, PP. 1391-1400, Dec. 1986) as one of the adaptive microphone arrays was used as the first sound receiving unit 1. The AMNOR sound receiving unit is obtained by combining a digital filter and a microphone array constituted by a plurality of microphone elements and can receive sounds having a higher S/N ratio of 10 to 16 dB as compared with a single microphone element when a noise source is not located in the neighborhood of a speaker. One microphone element as a constituting element of the microphone array was used as the second sound receiving unit 2. The short time power was calculated every 10 ms with a window length of 30 ms.

The threshold value Th in the detection unit 84 based on the power was determined to be $Th=PMM\times0.5$ such that each uttered word was received every predetermined length of time (one second) and a difference PMM between the maximum and minimum short time powers was obtained. The threshold value Pth in the detection unit 85 based on the power difference PD was set to be 8 dB.

Correct word periods were obtained by applying the first conventional method (i.e., a method using only discrimination based on the power) to speech containing no noise.

Experimental Result

An S/N ratio of speech at a sound reception point was set by an output of the second sound receiving unit 2 to be −5 dB, and word periods were then detected.

Figures 17A, 17B, 17C, 17D:
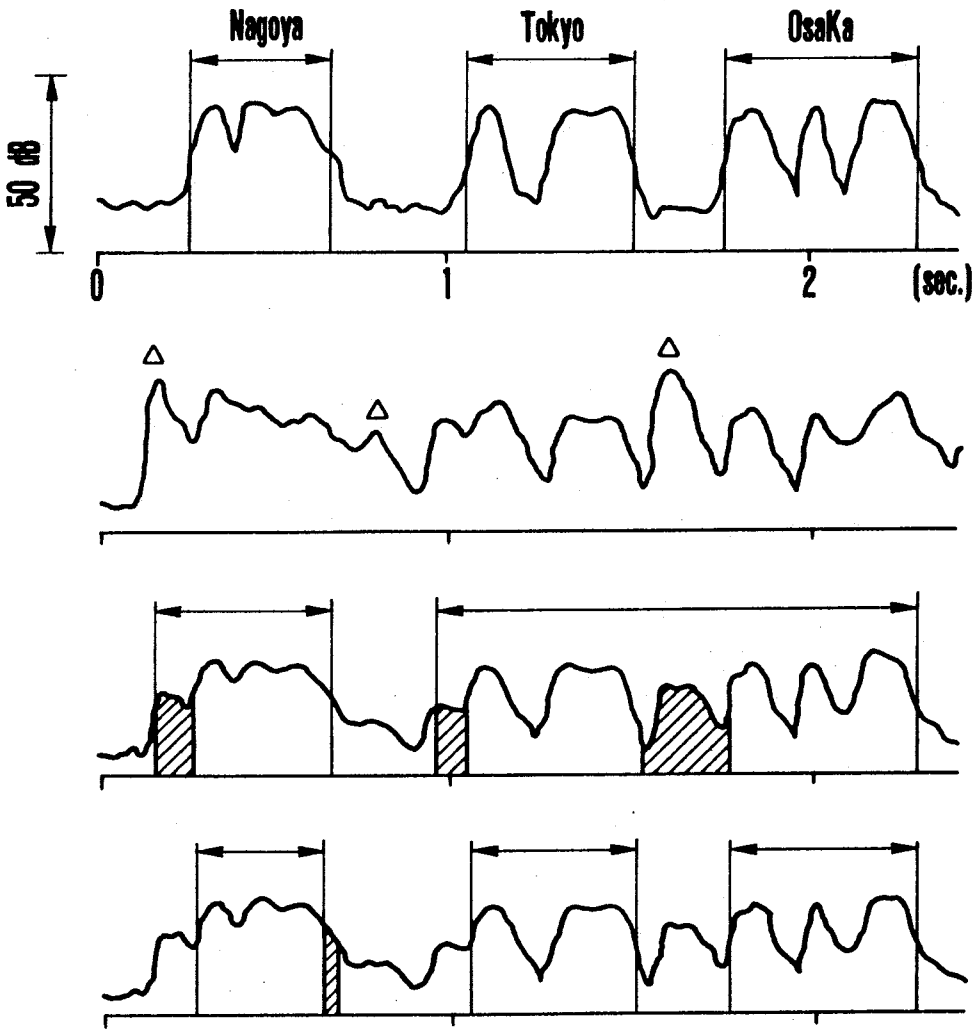
FIGS. 17(*a*), 17(*b*), 17(*c*), and 17(*d*) are charts showing experimental results to confirm effectiveness of the present invention.

FIGS. 17(*a*), 17(*b*), and 17(*c*) show an experimental result. FIG. 17(*a*) shows a speech power in a state without noise and correct word periods. FIG. 17(*b*) shows a power P2 of an output from the second sound receiving unit when undesired speech is added to input speech. FIG. 17(*c*) shows a power P1 of an output from the first sound receiving unit (AMNOR sound receiving unit) upon addition of undesired speech to the input speech and the word periods obtained by applying only discrimination based on the power. Each non-speech period within 200 ms between the detected speech periods was deemed to be part of the word period. Hatched portions in FIG. 17(*c*) are erroneously detected speech periods.

As compared with the case in FIGS. 17(*b*) and 17(*c*), noise power variations as a function of time are made small in an output from the adaptive microphone array (sharp peaks indicated by triangular marks in FIG. 17(*b*) become flat in FIG. 17(*c*)) .

FIG. 17(*d*) shows word periods discriminated by the method of the present invention, as indicated by arrows. A hatched portion is an erroneously detected period (the speech period is discriminated as a noise period). As is apparent from FIG. 17(*d*), the method of the present invention can be confirmed to be operated almost perfectly even under unstationary noise environment.

In order to quantitatively evaluate the experimental result, when each of the errors at the start and end points of each word period was within 50 ms, it was deemed as a correct detection, and a correct word detection rate was obtained. When the first conventional method which was frequently used in the speech recognition apparatus at present was applied to an output from the AMNOR sound receiving unit having a high S/N ratio, the correct word detection rate was 43%. To the contrary, the method of the present invention provided a correct word detection rate of 96%. An average detection error at the start or end point of the word period was about 20 ms.

Additional experiments in which the noise source was located at various positions except the +30° range (when a speaker is viewed from the sound receiving unit) were conducted. In these experiments, the correct word detection rates of about 95% were achieved by the present invention. Effectiveness of the speech period detection method of the present invention was thus confirmed.

When a unidirectional microphone was used as the first sound receiving unit, and when a noise source is present within an angular range of about 90° centered on the microphone with respect to a line obtained by connecting the speaker and the microphone in the speaker direction, a correct word detection rate was about 10%, thus confirming that the present invention is a high-precision acoustic signal detection method.

As described above, according to the method of the present invention, the presence of a desired signal is discriminated by utilizing a difference between short time powers of a signal received by a first sound receiving unit (i.e., a microphone array system having a directivity control function) and a signal received by a second sound receiving unit being the first and second sound receiving units located at the same position. Therefore, a desired speech period in an unstationary noise environment can be detected with high precision unlike in the conventional method of this type.

For the application where slightly low performance can be acceptable, a sound receiving unit, which comprises a so-called "superdirectional sound receiving unit" and a selective filter, can be used as the first sound receiving unit of the present invention.

Figure 20:
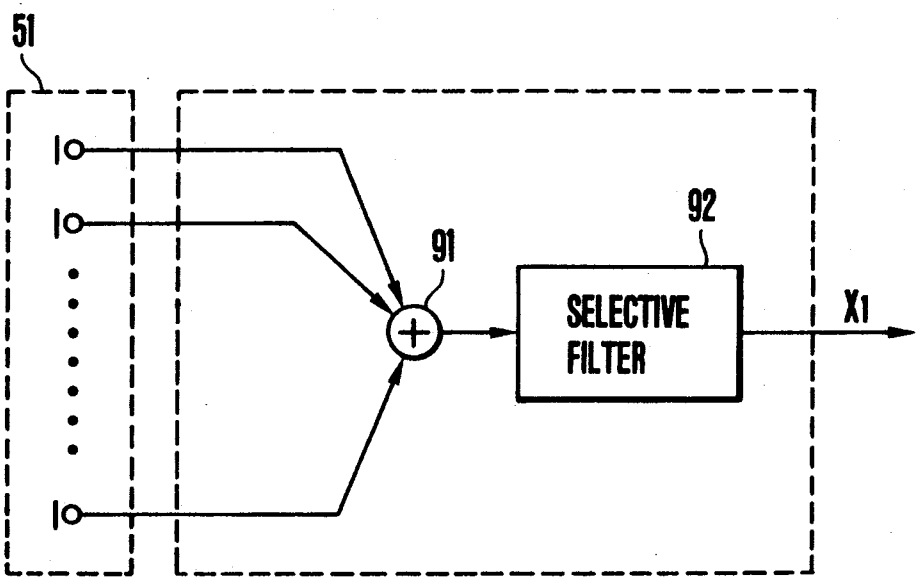

FIG. 20 shows one example of the arrangement of the above-mentioned sound receiving unit.

Referring to FIG. 20, reference numeral 51 denotes a microphone array; 91, an adder for adding microphone outputs and synthesizing superdirectivity: and 92, a selective filter connected to the adder 91.

As mentioned previously, an S/N ratio difference largely varies in both a low-frequency range and a high-frequency range when a "superdirectional sound receiving unit" is used. Therefore, the selective filter 92 selects such a frequency band in which the sound receiving unit keeps high sensitivity in the range where a speaker is assumed to move around, and low sensitivity outside the above mentioned range. As a result, the variation of S/N ratio in the output of the selective filter becomes very small independently of noise locations and speaker movement. Because the selected frequency range is not matched with the frequency range in which a speech signal has large power, and hence, the S/N ratio in the output from the first receiving unit becomes small, and the incorrect detections of this invention slightly increase by the usage of this sound receiving unit. However, this sound receiving unit has its merit of a very simple structure.

The inherent nature of the speech signal is not used in the present invention at all. In order to detect a speech period, however, it is very effective to combine a discrimination method utilizing the nature of the speech signal with the method of the present invention.

In practice, the first conventional method is sometimes used in combination with a discrimination method utilizing the nature of a speech signal. For example, known is a method for discriminating a speech period candidate having a period shorter than a expected value of a minimum duration of a speech signal as noise. Removal of an influence of impulsive noise in combination with the above discrimination method is very effective to detect a speech period correctly. Various other methods, such as a method for discriminating a nonperiodic signal period as a non-speech period by utilizing the periodicity nature of speech signals, are also known. These conventional discrimination methods can be easily combined with the present invention by a method of rediscriminating a period discriminated as a speech period or a method of finally determining a speech period by the majority upon a plurality of discrimination operations including the present invention.

As described above, the present invention can be combined with many speech period detection methods. As a result, the detection precision can be greatly improved in accordance with specific application purposes.

The first application field of the present invention is of speech recognition apparatuses, as has been described above.

The second application field is of acoustic echo cancelers. Acoustic echo cancellation is a technique for preventing howling or the like as a result of reception of sounds from a loudspeaker (receiver) by a microphone (sender). According to the principle of an echo canceler, acoustic transmission from the loudspeaker to the microphone is estimated, and an acoustic signal component from the loudspeaker is subtracted from a signal received by the microphone on the basis of the estimation result. Since the acoustic transmission from the loudspeaker to the microphone is changed as a function of time, estimation must be continuously performed. At this time, a condition in which a speaker does not utter any word (otherwise, a large estimation error occurs) is required. However, the presence/absence of the utterance is not always successfully discriminated, which poses a current problem in this technical field.

In order to solve this problem, the present invention is applied such that speech from the loudspeaker is deemed as undesired speech and speech from the speaker is deemed as desired speech, and that a speaker's utterance is detected at time when the presence of a desired speech signal is discriminated in a given period. The estimation operation for acoustic transmission is stopped when the utterance in detected, thus providing a high-performance acoustic echo canceler which can solve the above problem.

The third application field is of a speech storage technique. Assume that a large volume of continuous speech is to be converted into digital data and that the digital data are to be stored in a magnetic disk or the like. In this case, although an data compression technique by speech coding is important, it is also very important to detect a non-speech period, eliminating the detected non-speech period, or record non-speech period in a very small amount of information.

Since the method of the present invention does not employ the nature of the speech signal, any other sounds (e.g., music, mechanical sounds, and impulsive sounds) can be chosen as target sounds and can be detected. As a result, the present invention is applicable to variable apparatuses such as various monitoring apparatuses and measuring apparatuses.

What is claimed is:

1. A method of detecting an acoustic signal, comprising the steps of:

using first and second sound receiving units, located at the same position and having different directivity characteristics, for outputting signals having different target signal power to noise power ratios; and when a difference between logarithmic powers of said signals output from said first and second sound receiving units in a given period falls within a predetermined range, determining reception of the target signal within the given period, and using said first sound receiving unit in the form of an adaptive microphone array for controlling directivity characteristics in correspondence with a noise position.

2. The method according to claim 1, wherein said first sound receiving unit comprises a microphone array having a plurality of microphone elements, and a directivity controller connected to a plurality of outputs of said microphone array, and wherein said second sound receiving unit includes one of said microphone elements.

3. A method according to claim 1, further comprising the step of:

when the difference between the logarithmic powers of said signals output from said first and second sound receiving units in a given period falls within a predetermined range and a power of the signal output from a sound receiving unit having a higher signal power to noise power ratio in the given period falls within a predetermined range, discriminating reception of the target signal within the given period.

4. The method according to claim 1, wherein said first sound receiving unit comprises a microphone array constituted by a plurality of microphone elements, and a directivity controller connected to a plurality of outputs of said microphone array; and said second sound receiving unit comprises some of the microphone elements constituting said microphone array serving as said first sound receiving unit and a directivity synthesizer connected to said some of said microphone elements.

5. A method according to claim 1, further comprising the step of discriminating that the target signal is received in the given period only when the period in which it is determined that the target signal has been received as described exceeds an expected minimum continuous duration of said target signal.

* * * * *

UNITED STATES PATENT AND TRADEMARK OFFICE

CERTIFICATE OF CORRECTION

PATENT NO. : 5,208,864
DATED : May 4, 1993
INVENTOR(S) : Kaneda

It is certified that error appears in the above-identified patent and that said Letters Patent is hereby corrected as shown below:

In column 8 at lines 16-18 replace $$x_1^2 = \left( \sum_{k=1}^{M} k_k U_k \right)^2 \qquad (2)$$

with $$x_1^2 = \left( \sum_{k=1}^{M} h_k U_k \right)^2 \qquad (2)$$

In column 11 at line 42 after "signal" replace "x" with --$x_2$--;

In column 13 at line 15 after "noise component" replace "122" with --$12_2$--

UNITED STATES PATENT AND TRADEMARK OFFICE

CERTIFICATE OF CORRECTION

PATENT NO. : 5,208,864

DATED : May 4, 1993

INVENTOR(S) : Kaneda

It is certified that error appears in the above-indentified patent and that said Letters Patent is hereby corrected as shown below:

In column 4, line 68, column 9, line 60, and column 14, line 50, replace "the +30° range" with --the ±30° range--.

Signed and Sealed this

Twenty-first Day of November, 1995

*Attest:*

*Attesting Officer*

BRUCE LEHMAN

*Commissioner of Patents and Trademarks*